US011490735B2

(12) United States Patent
Kim

(10) Patent No.: US 11,490,735 B2
(45) Date of Patent: Nov. 8, 2022

(54) LEG SUPPORTER STRUCTURE FOR CHAIR SEAT PLATE

(71) Applicant: DUOBACK CO., LTD, Incheon (KR)

(72) Inventor: Eun Chul Kim, Incheon (KR)

(73) Assignee: Duoback Co., Ltd, Incheon (KR)

( * ) Notice: Subject to any disclaimer, the term of this patent is extended or adjusted under 35 U.S.C. 154(b) by 0 days.

(21) Appl. No.: 17/586,063

(22) Filed: Jan. 27, 2022

(65) Prior Publication Data

US 2022/0257019 A1 Aug. 18, 2022

(30) Foreign Application Priority Data

Feb. 16, 2021 (KR) ..... 10-2021-0020390

(51) Int. Cl.
*A47C 7/14* (2006.01)

(52) U.S. Cl.
CPC ..... *A47C 7/14* (2013.01)

(58) Field of Classification Search
CPC ..... A47C 7/14
USPC ..... 297/284.11, 440.22
See application file for complete search history.

(56) References Cited

U.S. PATENT DOCUMENTS 4,589,696 A * 5/1986 Kanai ..... B60N 2/1896 297/284.11 X
4,744,602 A * 5/1988 Campbell ..... A47D 15/006 297/284.11
4,746,168 A * 5/1988 Bracesco ..... B60N 2/665 297/284.11 X
4,753,479 A * 6/1988 Hatsutta ..... B60N 2/1892 297/284.11
4,767,155 A * 8/1988 Kousaka ..... B60N 2/62 297/284.11
4,775,185 A * 10/1988 Scholin ..... B60N 2/62 297/DIG. 8
4,915,447 A * 4/1990 Shovar ..... B60N 2/0284 297/284.11
5,380,063 A * 1/1995 Dauphin ..... A47C 1/023 297/284.11
5,388,888 A * 2/1995 Franzmann ..... B60N 2/1885 297/284.11

(Continued)

FOREIGN PATENT DOCUMENTS

DE 102008046000 A1 * 6/2009 ..... B60N 2/0232
GB 2347853 A * 9/2000 ..... B60N 2/4221

(Continued)

*Primary Examiner* — Rodney B White
(74) *Attorney, Agent, or Firm* — Delio Peterson & Curcio LLC; Peter W. Peterson

(57) ABSTRACT

A leg supporter structure for a chair seat plate, in which a leg supporter having a movable structure is mounted on a front end of a frame of a seat plate of a chair so that the leg supporter is rotated according to a user's body shape or posture, thereby softly supporting the user's popliteal part by minimizing pressure applied to the user's popliteal part. The leg supporter structure for a chair seat plate is applied to a chair seat plate to which a mesh member is combined with a frame of a predetermined shape, and includes: a lower frame of a rectangular shape; a U-shaped upper frame mounted along the upper surface of an outer wall of the lower frame; and a leg supporter of a bar shape which is mounted at an open front end of the upper frame to be selectively rotatable through rotary shafts disposed at both ends.

2 Claims, 8 Drawing Sheets

(56) References Cited

U.S. PATENT DOCUMENTS 5,716,099 A * 2/1998 McDiarmid ..... A47C 7/024 297/284.11
6,109,693 A * 8/2000 Bauer ..... B60N 2/1615 297/284.11 X
6,739,658 B2 * 5/2004 Pedronno ..... B60N 2/42745 297/284.11
6,837,540 B2 * 1/2005 Yamaguchi ..... B60N 2/42763 297/284.11
6,890,030 B2 * 5/2005 Wilkerson ..... A47C 1/023 297/284.11 X
6,908,149 B1 * 6/2005 Yamaguchi ..... B60N 2/42781 297/284.11
6,926,361 B2 * 8/2005 Link ..... A47C 1/023 297/284.11
7,909,401 B2 * 3/2011 Hofmann ..... B60N 2/0284 297/284.11
7,997,648 B2 * 8/2011 Becker ..... B60N 2/0284 297/284.11
8,128,167 B2 * 3/2012 Zhong ..... B60N 2/62 297/284.11
8,210,611 B2 * 7/2012 Aldrich ..... A47C 1/03266 297/284.11 X
8,272,687 B2 * 9/2012 Gross ..... B60N 2/4221 297/284.11
8,297,697 B2 * 10/2012 Gross ..... B60N 2/42718 297/284.11
8,366,194 B2 * 2/2013 Yamamoto ..... B60N 2/0232 297/284.11
8,888,181 B2 * 11/2014 Perraut ..... B60N 2/1839 297/284.11
9,016,785 B2 * 4/2015 Freisleben ..... B60N 2/0284 297/284.11
2001/0022460 A1 * 9/2001 Kondo ..... B60N 2/62 297/284.11
2001/0038234 A1 * 11/2001 Drira ..... A47C 7/024 297/284.11
2005/0258678 A1 * 11/2005 Wilkerson ..... A47C 7/282 297/337
2007/0080527 A1 * 4/2007 Itoga ..... B60R 21/18 297/284.11
2016/0137104 A1 * 5/2016 Bortolon ..... B60N 2/0284 297/284.11

FOREIGN PATENT DOCUMENTS

JP 2003237433 A * 8/2003 ..... B60N 2/181
JP 2004033543 A 2/2004
KR 10201501669 3/2016

* cited by examiner

LEG SUPPORTER STRUCTURE FOR CHAIR SEAT PLATE

BACKGROUND OF THE INVENTION

Field of the Invention

The present invention relates to a leg supporter structure for a chair seat plate, and more particularly, to a leg supporter structure for a chair seat plate, in which a leg supporter having a specific structure is mounted on a front end of a seat plate of a chair so that the leg supporter is moved around rotary shafts according to a user's body shape or posture, thereby stably supporting the user's popliteal part.

Description of Related Art

In general, a chair is provided to maintain a seating state when a user performs a task or studies using a desk or a table at various places, such as houses, offices, schools, institutes, libraries, various public institutions, and the likes.

The chair includes a seat plate on which a user's buttocks is located, a support leg mounted at a lower portion of the seat plate such that the seat plate is mounted at a point having a predetermined height from the floor surface, and a backrest provided at the rear side of the seat plate such that the user can lean the back against the backrest.

Moreover, recently, a mesh material having excellent air permeability, lightweightness and aesthetic sensibility has been widely applied not only to a backrest of a chair but also to a seat plate.

In order to apply a mesh structure to a seating part of the chair seating plate, a frame having an approximately rectangular shape is formed and a mesh material is fixed and mounted through the frame such that the seating part of the seat plate for allowing the user to sit on the chair. In this instance, a soft material, such as sponge, is combined with the front end of the frame corresponding to the popliteal part of the user who is sitting on the chair, thereby reducing pressure applied to the user's popliteal part.

However, when a mesh structure is applied to a conventional chair seat, a predetermined mesh member is coupled through a frame in the form of a rectangular frame having a fixed shape to form a seat plate of a corresponding chair, and thus a problem caused by a user sitting on the chair is affected by a strong pressure in accordance with the posture or body shape of a user seated on the chair.

PATENT LITERATURE

Patent Documents

Patent Document 1: Korean Patent Publication No. 10-2015-0122484

Patent Document 2: Korean Patent No. 10-1885598

SUMMARY OF THE INVENTION

Accordingly, the present invention has been made to solve the above-mentioned problems occurring in the prior arts, and it is an object of the present invention to provide a leg supporter structure for a chair seat plate, in which a leg supporter having a movable structure mounted on a front end of a frame of a seat plate of a chair so that the leg supporter is rotated according to a user's body shape or posture, thereby softly supporting the user's popliteal part by minimizing pressure applied to the user's popliteal part.

To accomplish the above object, according to the present invention, there is provided a leg supporter structure for a chair seat plate, which is applied to a chair seat plate to which a mesh member is combined with a frame of a predetermined shape, the leg supporter structure including: a lower frame of a rectangular shape; an upper frame having a shape of a "ㅗ"-shape mounted along the upper surface of an outer wall of the lower frame; and a leg supporter of a bar shape which is mounted at an open front end of the upper frame to be selectively rotatable through rotary shafts disposed at both ends.

Preferably, both inner walls and a rear wall of the lower frame are formed to be rounded inwards from an upper end to a lower end, the front end of the lower frame on which the leg supporter is mounted is formed to have a horizontal plane, supporter mounting members which respectively have rotary shaft mounting grooves and a pair of screw fastening grooves formed to be recessed in the upper surface of a rectangular-parallelepiped shape thereof protrude respectively at the front ends of both inner walls of the lower frame, and the rotary shafts disposed at both ends of the leg supporter are respectively finished by cover members after being put in the rotary shaft mounting grooves of the supporter mounting members.

More preferably, a spring mounting groove is formed at a rear edge portion of the upper surface of the supporter mounting member to be recessed, a spring fixing protrusion protrudes from a rear edge portion of the lower surface of the leg supporter to correspond to the spring mounting groove, and both ends of the spring applying an external force toward the upper surface are respectively fixed at predetermined points of the leg supporter through the spring mounting groove and the spring fixing protrusion.

According to the present invention, as described above, the leg supporter structure for a chair seat plate can softly support the user's popliteal part by minimizing pressure applied to the user's popliteal part while the leg supporter, which is rotatably formed at the front end of the frame of the seat plate of the chair, is rotated according to the user's body shape or posture, thereby providing a high-quality chair having a good feeling of seating.

BRIEF DESCRIPTION OF THE DRAWINGS

The above and other objects, features and advantages of the present invention will be apparent from the following detailed description of the preferred embodiments of the invention in conjunction with the accompanying drawings, in which.

DESCRIPTION OF THE EMBODIMENT(S)

Hereinafter, the present invention will be described in detail with reference to the accompanying drawings.

Figure 1:
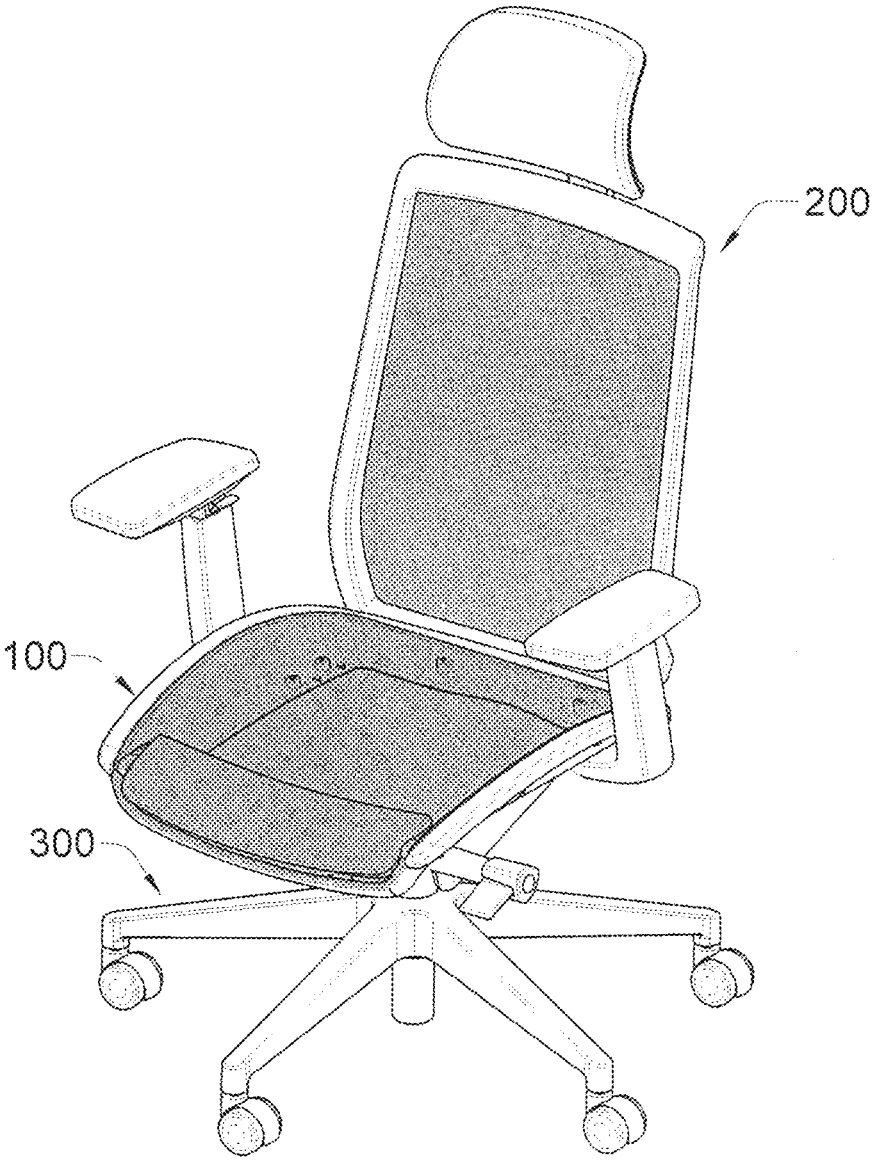
FIG. 1 is a perspective view illustrating the appearance of a chair to which a leg supporter structure of a chair seat plate according to the present invention is applied.

FIG. 1 is a perspective view illustrating the appearance of a chair to which a leg supporter structure of a chair seat plate according to the present invention is applied.

Figure 2:
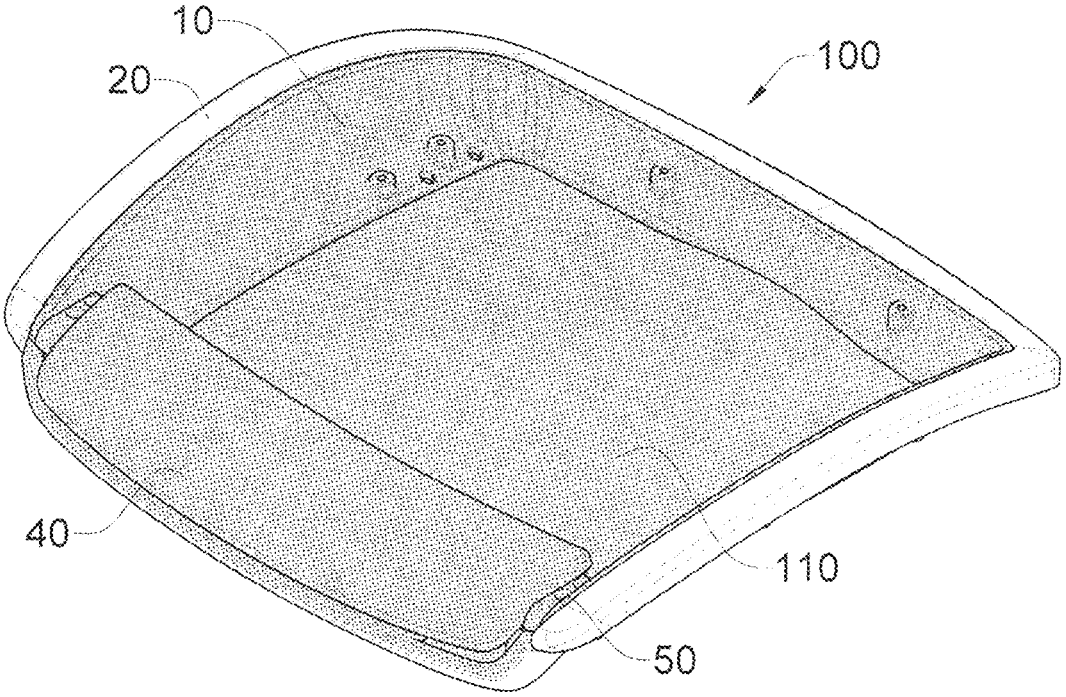
FIG. 2 is a perspective view illustrating the appearance of a chair seat plate to which the leg supporter structure of a chair seat plate according to the present invention is applied.

FIG. 2 is a perspective view illustrating the appearance of a chair seat plate to which the leg supporter structure of a chair seat plate according to the present invention is applied.

Figure 3:
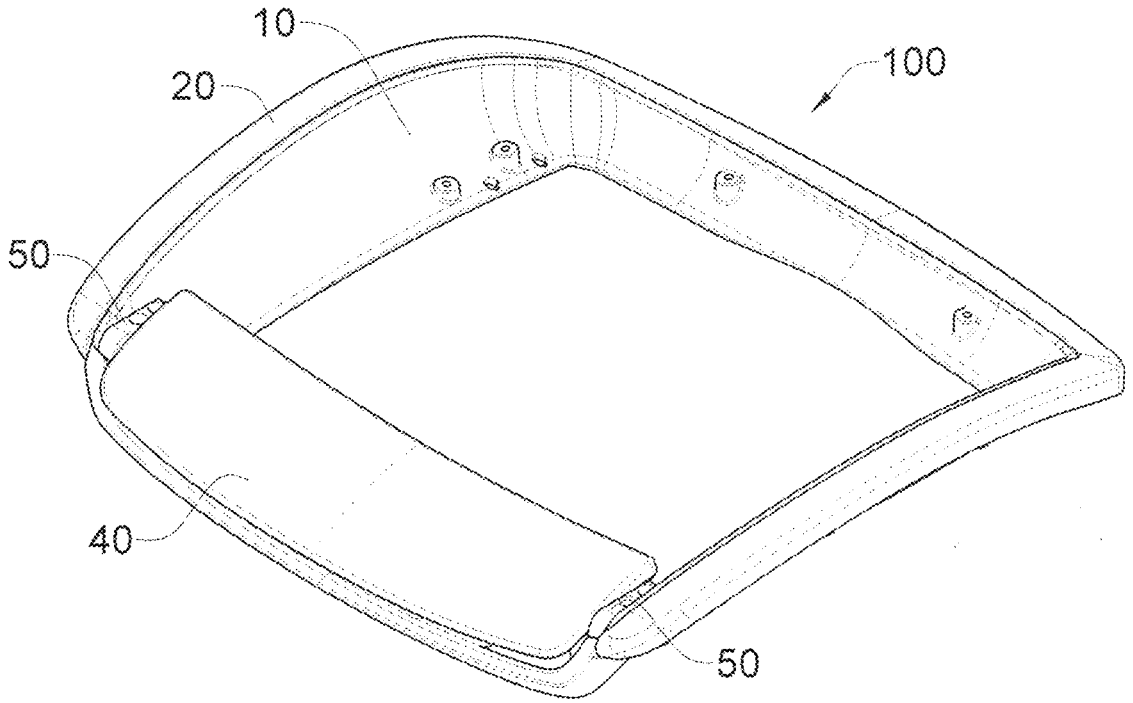
FIG. 3 is a perspective view of the chair seat plate to which the leg supporter structure of a chair seat plate according to the present invention is applied.

FIG. 3 is a perspective view of the chair seat plate to which the leg supporter structure of a chair seat plate according to the present invention is applied.

Figure 4A:
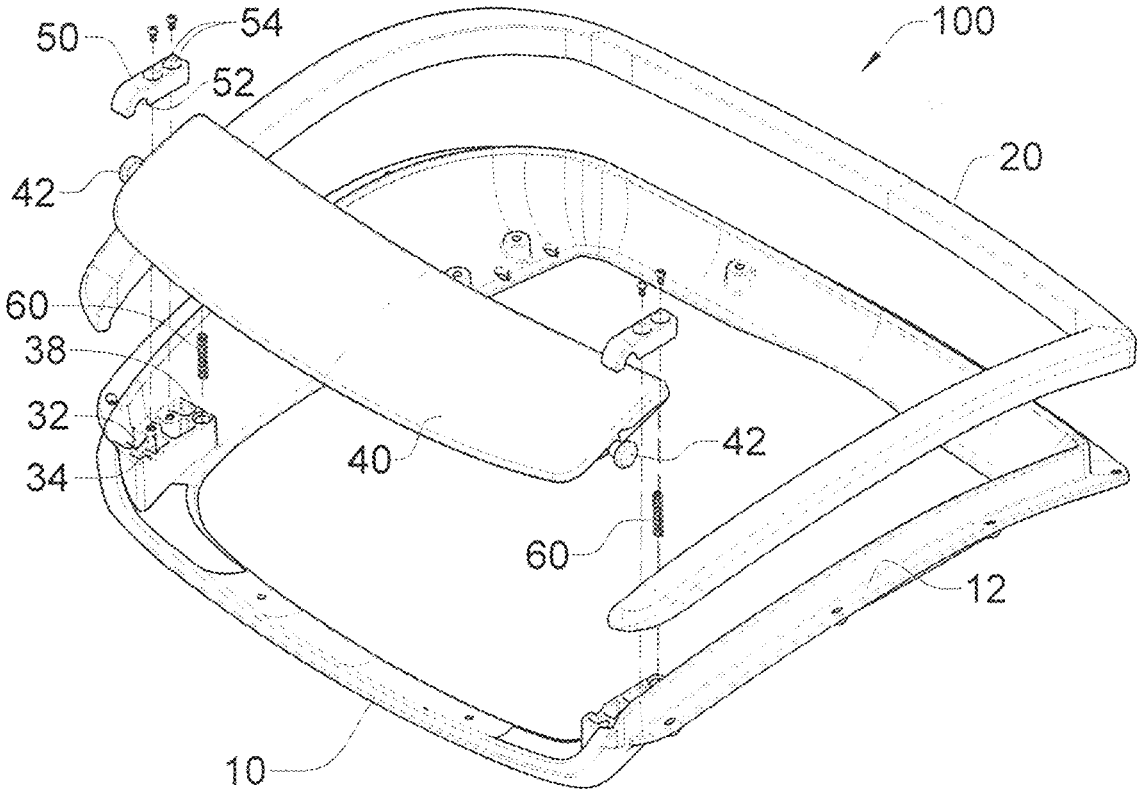
FIGS. 4A and 4B are perspective view illustrating the configuration of the chair seat plate to which the leg supporter structure of a chair seat plate according to the present invention is applied.
Figure 4B:
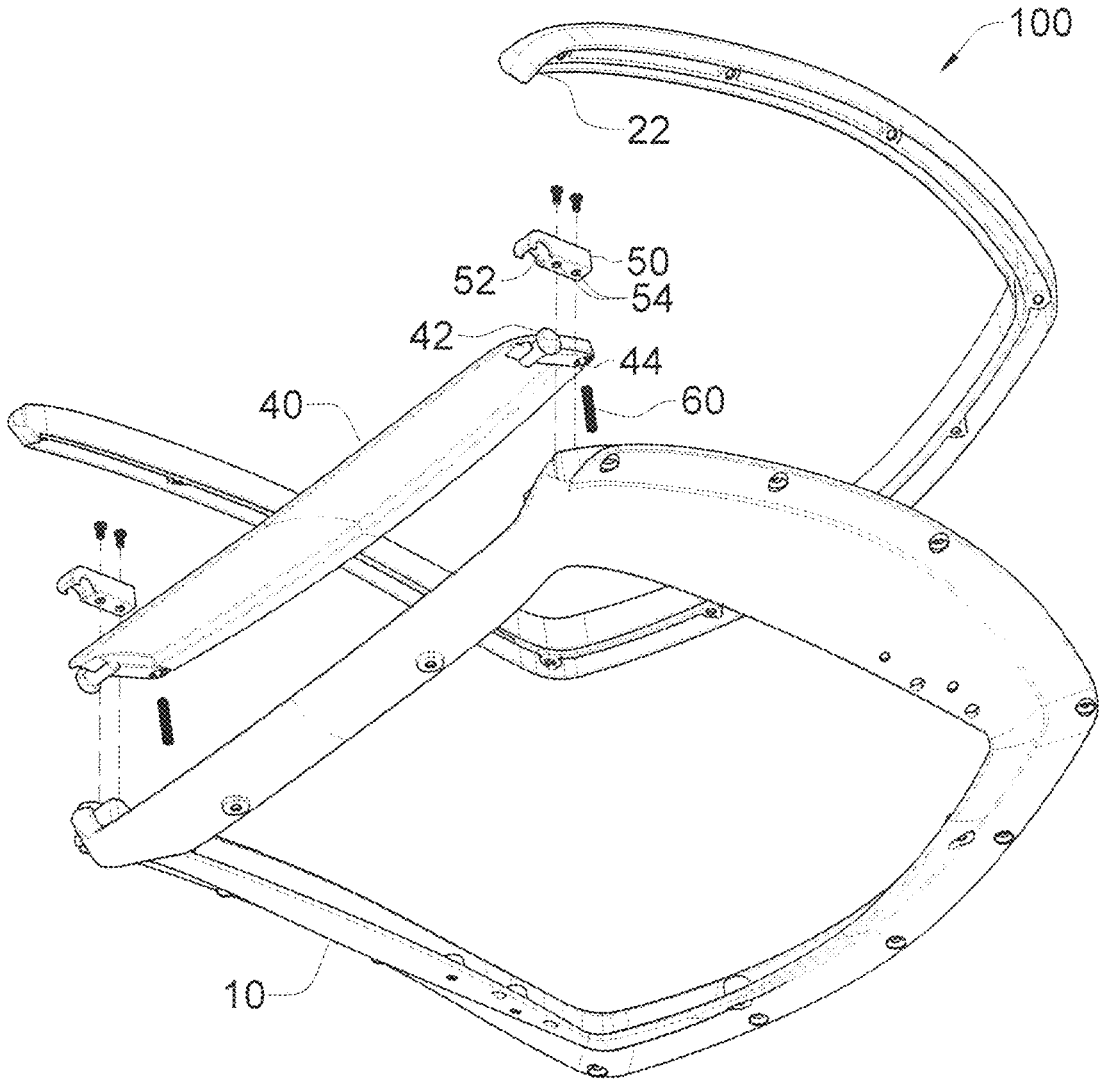

FIGS. 4A and 4B are perspective view illustrating the configuration of the chair seat plate to which the leg supporter structure of a chair seat plate according to the present invention is applied.

Figure 5:
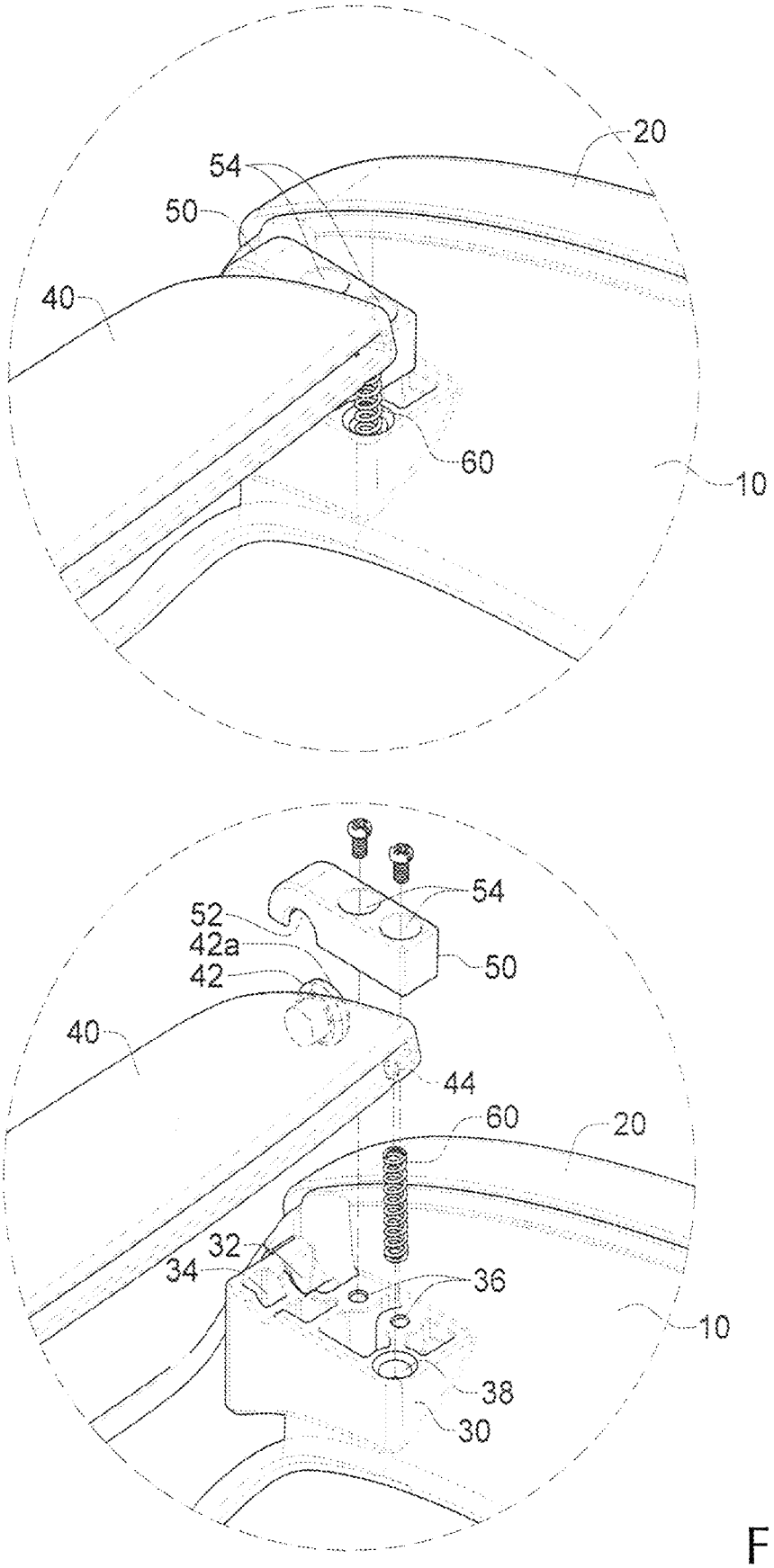
FIG. 5 is a partially enlarged perspective view and an enlarged perspective view of the chair seat plate to which the leg supporter structure of a chair seat plate according to the present invention is applied.

FIG. 5 is a partially enlarged perspective view and an enlarged perspective view of the chair seat plate to which the leg supporter structure of a chair seat plate according to the present invention is applied.

First, the leg supporter structure of a chair seat according to the present invention forms a leg supporter having a rotatable structure formed on a seat plate of a chair, which is made of a mesh material, so as to softly support a user's popliteal part while the leg supporter naturally moves according to the user's body shape or posture.

As illustrated in FIG. 1, a chair to which a leg supporter structure of a chair seat according to the present invention includes: a seat plate 100 provided at a point having a predetermined height from the ground via a support leg 300; and a backrest 200 formed on the rear side of the seat plate 100 to be formed at approximately right angles, wherein the seat plate 100 and the backrest 200 have a mesh material, which has a self-elastic force and excellent air permeability and is mounted in a frame of a predetermined shape.

In accordance with the leg supporter structure of the chair seat according to an embodiment of the present invention illustrated in FIGS. 2 to 5, the seat plate 100 of the chair is applied to a seat plate of a chair in which a mesh member 110 is combined with the frame of the predetermined shape, wherein the frame includes a lower frame 10 having an approximately rectangular shape and an upper frame 20 having a shape of an approximately "ㅗ"-shape, and a leg supporter 40 having an approximately bar shape is mounted at an open front end of the upper frame 20 in a rotatable manner.

The lower frame 10 is formed in a rectangular shape, and the front end of the lower frame 10 has a horizontal surface, and the leg supporter 40 is positioned on the upper portion thereof.

Both inner walls and a rear wall of the lower frame 10 are formed to be rounded inwards from an upper end to a lower end, and a seating jaw 12 is formed integrally on the outer surface of both outer walls and the rear wall of the lower frame 10 in a horizontal direction, so that the upper frame 20 is fixedly mounted on the seating jaw 12 to be supported.

The upper frame 20 is mounted along the outer wall of the lower frame 10 by means of the seating jaw 12 provided on the lower frame 10, and a retaining jaw 22 of an approximately hook shape is formed at both end portions of the upper frame 20 so as to be finished to be restrained at an end portion of the seating jaw 12.

Moreover, in order to mount the leg supporter 40, supporter mounting members 30 are respectively formed to protrude at front ends of both inner walls of the lower frame 10 in an approximately rectangular shape.

A rotary shaft mounting groove 32 is formed at a point of the upper surface of the supporter mounting member 32 to be recessed to a predetermined depth so as to restrain an expanded part 42*a* disposed at an end portion of a rotary shaft 42 of the leg supporter 40. An extension part 34 is formed at one side of the rotary shaft mounting groove 32 to communicate so that the rotary shaft 42 of the leg supporter 40 is seated on the extension part 34 and penetrates through one side wall of the supporter mounting member 30.

Furthermore, a pair of screw fastening grooves 36 and one spring mounting groove 38 are formed to be recessed at a predetermined point on the upper surface of the supporter mounting member 30.

One side of the open upper surface of the supporter mounting member 30 is finished through a cover member 50 while the rotary shaft 42 of the leg supporter 40 is seated thereon. The cover member 50 has an approximately rectangular parallelepiped shape with an open lower surface. A pair of screw fastening holes 54 are bored to correspond to the screw fastening grooves 36 of the supporter mounting member 30. Additionally, a rotary shaft mounting groove 52, through which the rotary shaft 42 seated on the supporter mounting member 30 penetrates, is formed in one side wall of the cover member in an approximately semicircular shape.

The leg supporter 40 is formed in an approximately bar shape, and has the rotary shafts 42, which are formed at both ends thereof and respectively have the expanded parts 42*a* of an approximately disk shape. Through the rotary shaft mounting grooves 32 and 52 disposed at the supporter mounting member 30 and the cover member 50, the leg supporter 40 is mounted to be selectively rotatable at a predetermined angle.

In this instance, both ends of a spring 60 are fixed through a spring fixing protrusion 44 formed at the rear edge portion of the lower surface of the leg supporter 40 and a spring mounting groove 38 formed at the rear edge portion of the upper surface of the supporter mounting member 30 so as to apply external force toward the upper side at the rear side of the leg supporter 40.

Preferably, the leg supporter 40 is made of a variety of soft materials, such as rubber, silicon, soft plastic, and the like, so as to smoothly support the popliteal part of the user who is sitting on the chair.

Next, an operation of the present invention will be described referring to the drawings.

According to an embodiment of the present invention, the leg supporter 40 of the specific structure to support the popliteal part of the user who is sitting on the chair is mounted on the seat plate 10 of the chair to which a predetermined mesh member 110 is applied to be movable.

The leg supporter 40 is selectively rotated according to a body shape and a sitting posture of the user, who is sitting on the seat plate 100 of the chair to support the user's popliteal part, so that the user can maintain a more comfortable sitting posture since pressure applied to the user's popliteal part is changed appropriately.

Figure 6A:
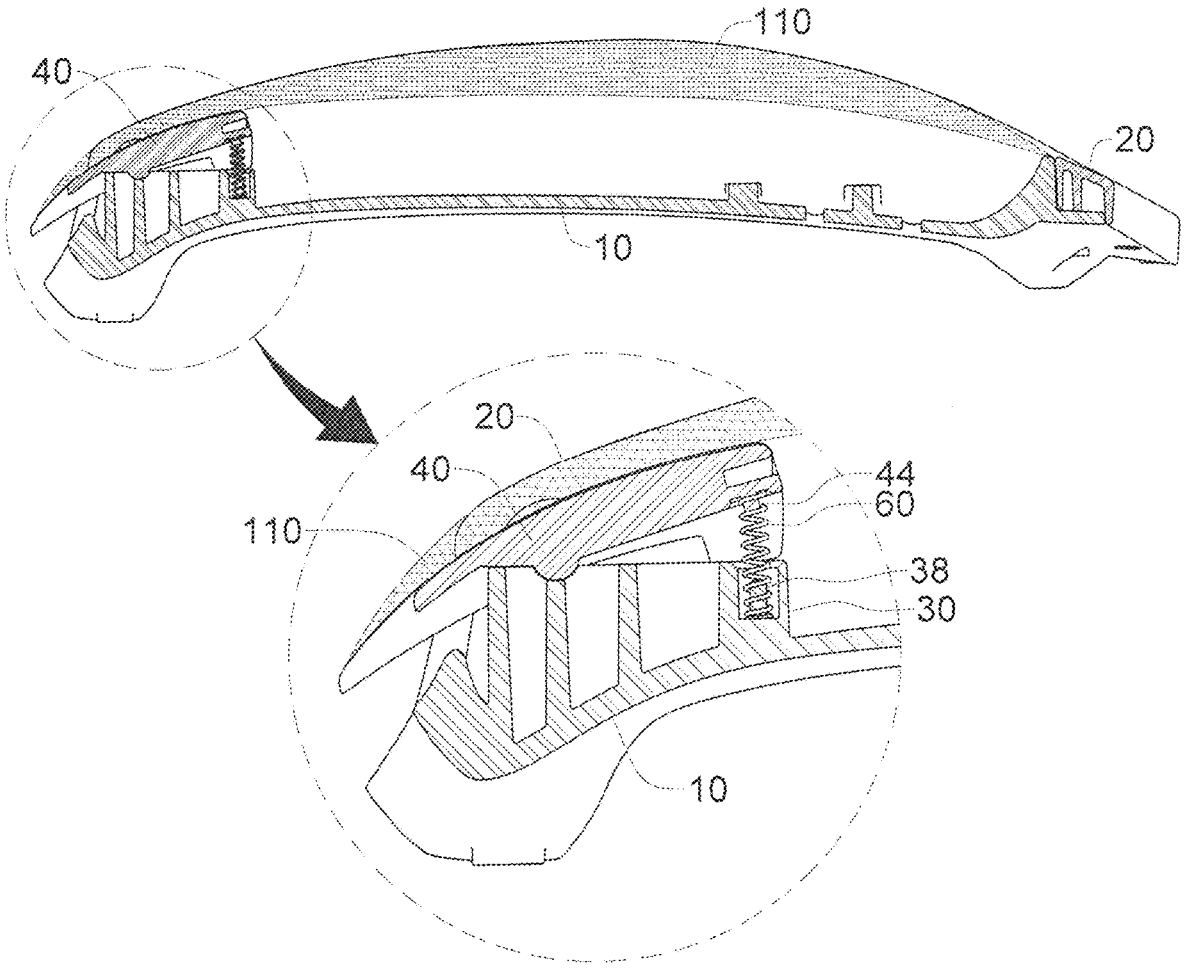
FIGS. 6A and 6B are side views illustrating an operational state of the leg supporter of the chair seat plate to which the leg supporter structure of the chair seat plate according to the present invention is applied.
Figure 6B:
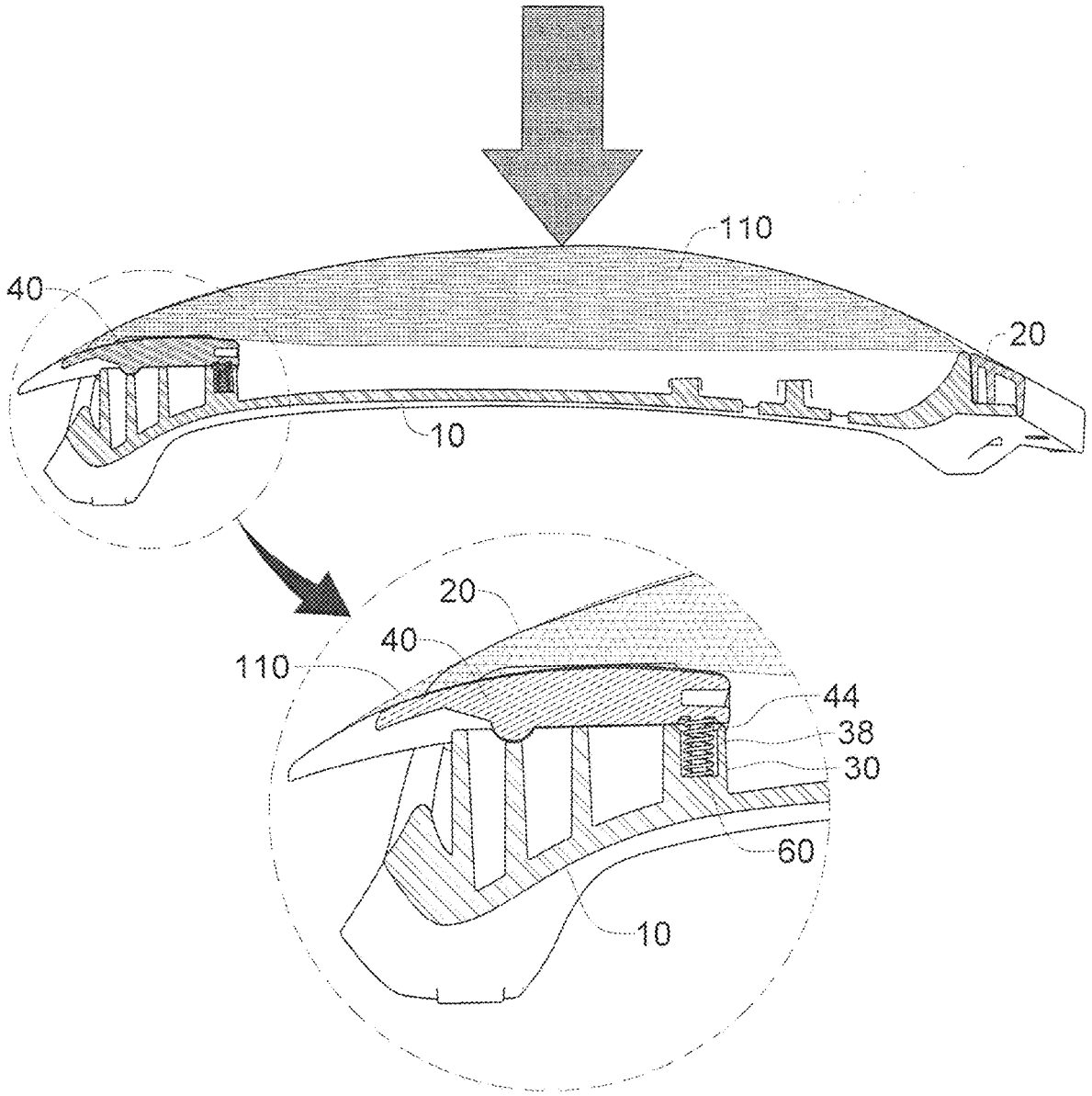

That is, when the user sits on the seat plate 100, pressure is applied to the mesh member 110 disposed on the seat plate 100, and at the same time, the leg supporter 40 connected with the mesh member rotates around the rotary shaft 42 due to the pressure applied to the mesh member 110 so as to support the user's popliteal part while the front end of the leg supporter rises as high as the predetermined angle (from FIG. 6*a* to FIG. 6*b*).

Both ends of the leg supporter 40 can be supported on the open upper surface of the supporter mounting member 30.

Accordingly, the user who is sitting on the seat plate 100 of the chair can maintain a more comfortable sitting feeling while the user's popliteal part is supported stably.

In this instance, when the user deeply sits toward the backrest 200, the pressure applied to the leg supporter 40 is increased to more strongly support the popliteal part. Meanwhile, when the user sits away from the backrest 200, the pressure applied to the leg supporter 40 becomes smaller so as to support the popliteal part slightly.

That is, the leg supporter 40 can support the popliteal part with an appropriate pressure according to the leg position of the user who is sitting on the chair.

In addition, when the user who is sitting on the seat plate 100 of the chair is separated from the seat plate 100, the pressure applied to the mesh member 110 of the seat plate 100 is released, so that the leg supporter 40 is returned to its original state while the rotary shafts 42 are rotated as much as a predetermined angle by a restoring force of a pair of the springs 60 mounted at both rear ends of the lower surface thereof and the rear end of the leg supporter is raised.

While the exemplary embodiments of the present invention have been described in more detail with reference to the accompanying drawings, but the present invention is not essentially limited to the exemplary embodiments, and it will be understood by those of ordinary skill in the art that various modifications and equivalents may be made without deviating from the spirit or scope of the invention, and that such modifications and amendments shall not be individually understood from the technical idea or prospect of the present invention.

The invention claimed is:

1. A leg supporter structure for a chair seat plate, which is applied to a chair seat plate to which a mesh member is combined with a frame of a predetermined shape, the leg supporter structure comprising:

a lower frame of a rectangular shape, the lower frame having a front end formed to have a horizontal plane, a pair of inner walls, a rear wall, and an outer wall with an upper surface, both inner walls and the rear wall of the lower frame being formed to be rounded inwards from an upper end to a lower end, both inner walls having front ends at the front end of the lower frame;

a U-shaped upper frame having an open front end, the upper frame being mounted along the upper surface of the outer wall of the lower frame;

leg supporter mounting members having a rectangular-parallelepiped shape protruding respectively at the front ends of both inner walls of the lower frame, the leg supporter mounting members having in an upper surface thereof recessed rotary shaft mounting grooves and a pair of screw fastening grooves; and a leg supporter of a bar shape mounted on the front end of the lower frame at the open front end of the upper frame, the leg supporter being selectively rotatable through rotary shafts disposed at both ends and seated in the rotary shaft mounting grooves of the leg supporter mounting members, wherein the rotary shafts disposed at both ends of the leg supporter are respectively finished by cover members after being put in the rotary shaft mounting grooves of the supporter mounting members.

2. The leg supporter structure according to claim 1, wherein the leg supporter mounting members have upper surfaces, the recessed spring mounting grooves being formed at a rear edge portion of each of the upper surfaces of the leg supporter mounting members, and wherein the leg supporter has a lower surface with spring fixing protrusions protruding from a rear edge portion of the lower surface of the leg supporter to correspond to the spring mounting grooves, and further including springs having ends respectively fixed at predetermined points of the leg supporter through the spring mounting grooves and the spring fixing protrusions, wherein both ends of the springs apply an external force toward the upper surfaces of the leg supporter mounting members.

* * * * *